US009863336B2

(12) United States Patent
MacNeille et al.

(10) Patent No.: US 9,863,336 B2
(45) Date of Patent: Jan. 9, 2018

(54) SYSTEM AND METHOD FOR ESTIMATING AMBIENT HUMIDITY

(71) Applicant: Ford Global Technologies, LLC, Dearborn, MI (US)

(72) Inventors: Perry Robinson MacNeille, Lathrup Village, MI (US); David Charles Weber, Toledo, OH (US)

(73) Assignee: Ford Global Technologies, LLC, Dearborn, MI (US)

( * ) Notice: Subject to any disclaimer, the term of this patent is extended or adjusted under 35 U.S.C. 154(b) by 416 days.

(21) Appl. No.: 14/286,631

(22) Filed: May 23, 2014

(65) Prior Publication Data

US 2015/0337745 A1 Nov. 26, 2015

(51) Int. Cl.

| | |
|---|---|
| ***F02D 41/14*** | (2006.01) |
| ***F02P 5/15*** | (2006.01) |
| ***F02D 37/02*** | (2006.01) |
| *F02D 41/00* | (2006.01) |

(52) U.S. Cl.

CPC ..... *F02D 37/02* (2013.01); *F02D 41/1401* (2013.01); *F02D 41/0047* (2013.01); *F02D 2041/001* (2013.01); *F02D 2200/0414* (2013.01); *F02D 2200/0418* (2013.01); *F02D 2200/703* (2013.01); *F02P 5/1514* (2013.01)

(58) Field of Classification Search

CPC .. F02D 37/02; F02D 41/1401; F02D 41/0047; F02D 2200/0418; F02D 2200/0414; F02D 2041/001; F02D 2200/703; F02P 5/1514

See application file for complete search history.

(56) References Cited

U.S. PATENT DOCUMENTS

| | | | | |
|---|---|---|---|---|
| 5,735,245 | A * | 4/1998 | Kubesh | F02D 37/02 123/406.55 |
| 6,708,496 | B2 * | 3/2004 | Gadde | F02C 9/28 60/39.281 |
| 6,725,848 | B2 | 4/2004 | Ramaurthy et al. | |
| 6,948,475 | B1 | 9/2005 | Wong et al. | |
| 8,155,867 | B2 * | 4/2012 | Krause | G07C 5/008 455/39 |
| 8,296,042 | B2 | 10/2012 | Xiao et al. | |
| 9,452,661 | B2 * | 9/2016 | Eisenhour | B60H 1/3207 |
| 2009/0130966 | A1 * | 5/2009 | Tucker | B60H 1/00821 454/75 |
| 2012/0310536 | A1 * | 12/2012 | Katayama | G01C 21/3461 702/3 |
| 2013/0144470 | A1 | 6/2013 | Ricci | |

(Continued)

OTHER PUBLICATIONS

Styles, Daniel J. et al., "Engine Cooling Fan to Reduce Charge Air Cooler Corrosion," U.S. Appl. No. 13/656,471, filed Oct. 19, 2012, 44 pages.

(Continued)

*Primary Examiner* — David Hamaoui

(74) *Attorney, Agent, or Firm* — Julia Voutyras; McCoy Russell LLP

(57) ABSTRACT

Methods and systems are provided for estimating ambient humidity based on a wet bulb temperature and a dry bulb temperature during precipitation, and estimating ambient humidity based on the dry bulb temperature and not based on wet bulb temperature when precipitation is absent.

7 Claims, 6 Drawing Sheets

(56) References Cited

U.S. PATENT DOCUMENTS

2013/0275030 A1 10/2013 Kim et al.
2014/0238370 A1* 8/2014 Pursifull ..... F02D 41/005
123/690

OTHER PUBLICATIONS

Glugla, Chris P. et al., "Method for Purging Condensate From a Charge Air Cooler," U.S. Appl. No. 13/656,511, filed Oct. 19, 2012, 48 pages.
Styles, Daniel J. et al., Charge Air Cooler (CAC) Corrosion Reduction Utilizing Grille Shutters, U.S. Appl. No. 13/656,524, filed Oct. 19, 2012, 33 pages.
Surnilla, Gopichandra et al., "Engine Control Coordination with Grille Shutter Adjustment and Ambient Conditions," U.S. Appl. No. 13/656,542, filed Oct. 19, 2012, 33 pages.
Glugla, Chris P. et al., "System and Method to Identify Ambient Conditions," U.S. Appl. No. 13/672,571, filed Nov. 8, 2012, 34 pages.
Surnilla, Gopichandra et al., "Exhaust Humidity Sensor," U.S. Appl. No. 13/706,194, filed Dec. 5, 2012, 34 pages.
Rollinger, John E. et al., "Method for Estimating Charge Air Cooler Condensation Storage and/or Release with Two Intake Oxygen Sensors," U.S. Appl. No. 13/967,943, filed Aug. 15, 2013, 58 pages.
Surnilla, Gopichandra et al., "Method for Estimating Charge Air Condensation Storage and/or Release With an Intake Oxygen Sensor," U.S. Appl. No. 13/967,968, filed Aug. 15, 2013, 57 pages.
Surnilla, Gopichandra et al., "Method for Estimating Charge Air Cooler Condensation Storage with an Intake Oxygen Sensor," U.S. Appl. No. 14/065,147, filed Oct. 28, 2013, 39 pages.

* cited by examiner

SYSTEM AND METHOD FOR ESTIMATING AMBIENT HUMIDITY

FIELD

The present disclosure relates to systems and methods for estimating ambient air humidity.

BACKGROUND/SUMMARY

The concentration of water in ambient air may affect engine operation. For example, there may be a 5-8% error in determination of mass air flow in the absence of adjustments based on ambient air humidity. Therefore, engine operating parameters such as air-fuel ratio, spark timing, exhaust gas recirculation (EGR) and the like may be adjusted based on ambient air humidity to improve engine performance, boost fuel economy, and reduce emissions. Further, ambient air humidity may be used to adjust vehicle climate control parameters to improve safety, cabin comfort and driving experience.

Various approaches are utilized to estimate ambient air humidity. In one example approach, as shown by Kim et al. in US 2013/0275030, ambient humidity is measured based on a NOx sensor output. However, inventors herein have recognized disadvantages with such an approach. Specifically, ambient humidity estimated based on NOx sensor output may have reduced accuracy during periods of atmospheric instability such as during conditions when there is precipitation in the atmosphere. Further, when there is a change in humidity, such as during onset of rain, ambient humidity based on a NOx sensor output does not account for the sudden increase in humidity. Still further, the NOx sensor may be utilized to measure humidity only when fuel is shut-off while the engine continues to operate, such as during braking when the vehicle may travel downhill for a short period of time, to allow fresh air to circulate through the engine and the exhaust system. Therefore, it may not be possible to measure humidity when the humidity measurement is needed.

In one example, some of the above issues may be addressed by a method for an engine, comprising: adjusting engine operation based on an ambient specific humidity, the ambient specific humidity estimated based on a dry bulb temperature measured by a first sensor positioned on an exterior surface of a vehicle and shielded from weather, a wet bulb temperature measured by a second sensor positioned on the exterior surface of the vehicle and exposed to weather, and a barometric pressure in response to detecting precipitation.

In another example, a method for an engine comprises indicating a change in a rain condition based on a wet bulb temperature and a dry bulb temperature; and adjusting an estimated humidity based on the change in rain condition, and not utilizing the wet bulb temperature to estimate humidity depending on the rain state.

For example, rain may be detected based on a difference between wet bulb and dry bulb temperatures being greater than a threshold temperature. Upon detecting rain, specific humidity may be estimated based on wet bulb and dry bulb temperatures. Wet bulb temperature may be the temperature of rain drops measured by a wet bulb thermometer located on a surface of the vehicle. Dry bulb temperature may be temperature of intake air measured by a dry bulb thermometer located at an engine intake passage. A psychrometric interpolation table may be used to estimate specific humidity based on wet bulb and dry bulb temperatures. However, during conditions when rain is absent, specific humidity may be estimated based on dry bulb temperature and not wet bulb temperature. In this way, by utilizing wet bulb temperature and dry bulb temperature to estimate ambient specific humidity during rainy conditions, engine operating parameters may be adjusted with greater accuracy. Further, while the term thermometer is used herein as one example temperature sensor, various others may be used such as thermocouples, thermal diode, thermal resistor, etc.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
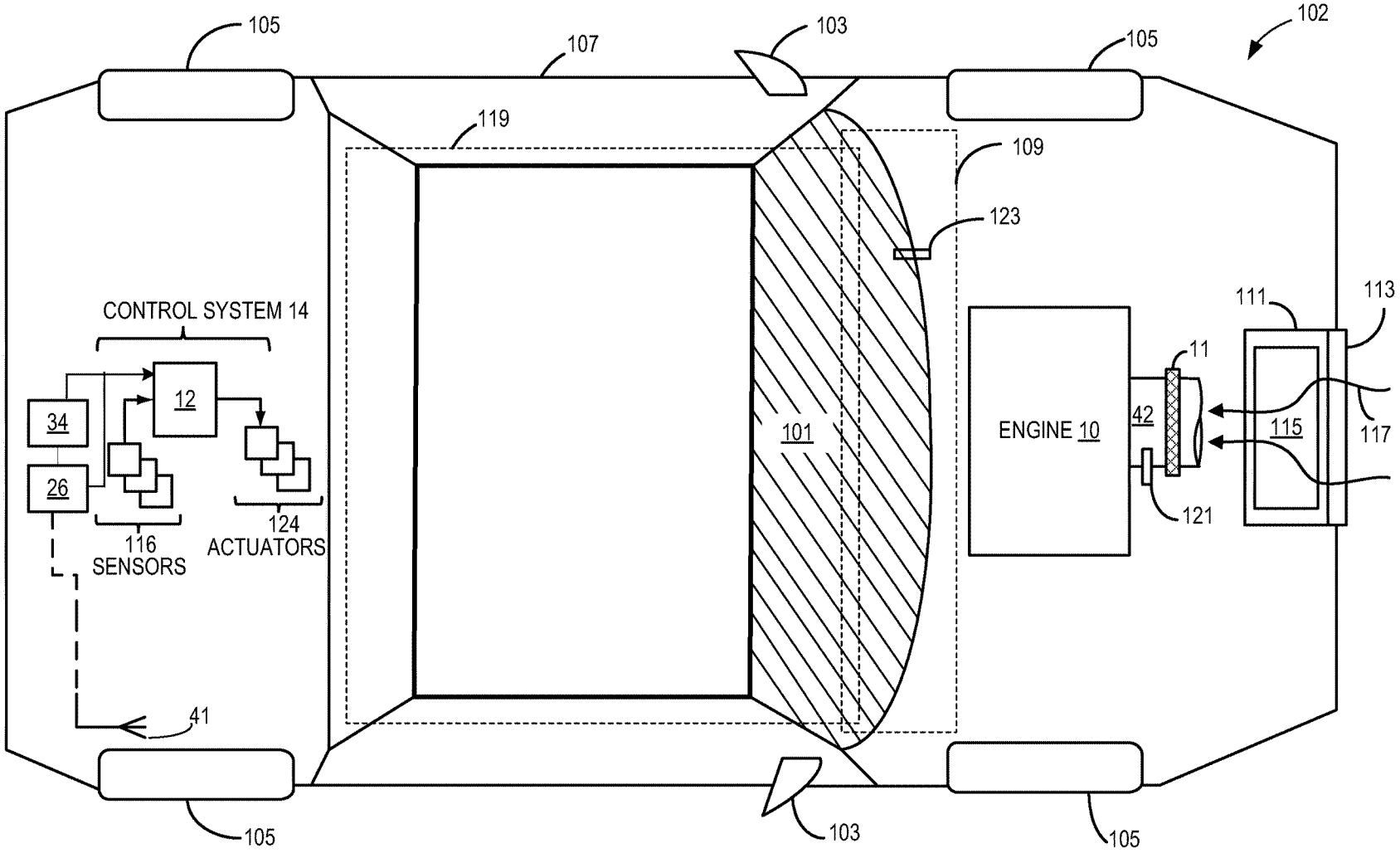
FIG. 1 shows a schematic diagram of an example vehicle system including a dry bulb thermometer and a wet bulb thermometer utilized for estimating ambient humidity.
Figure 2:
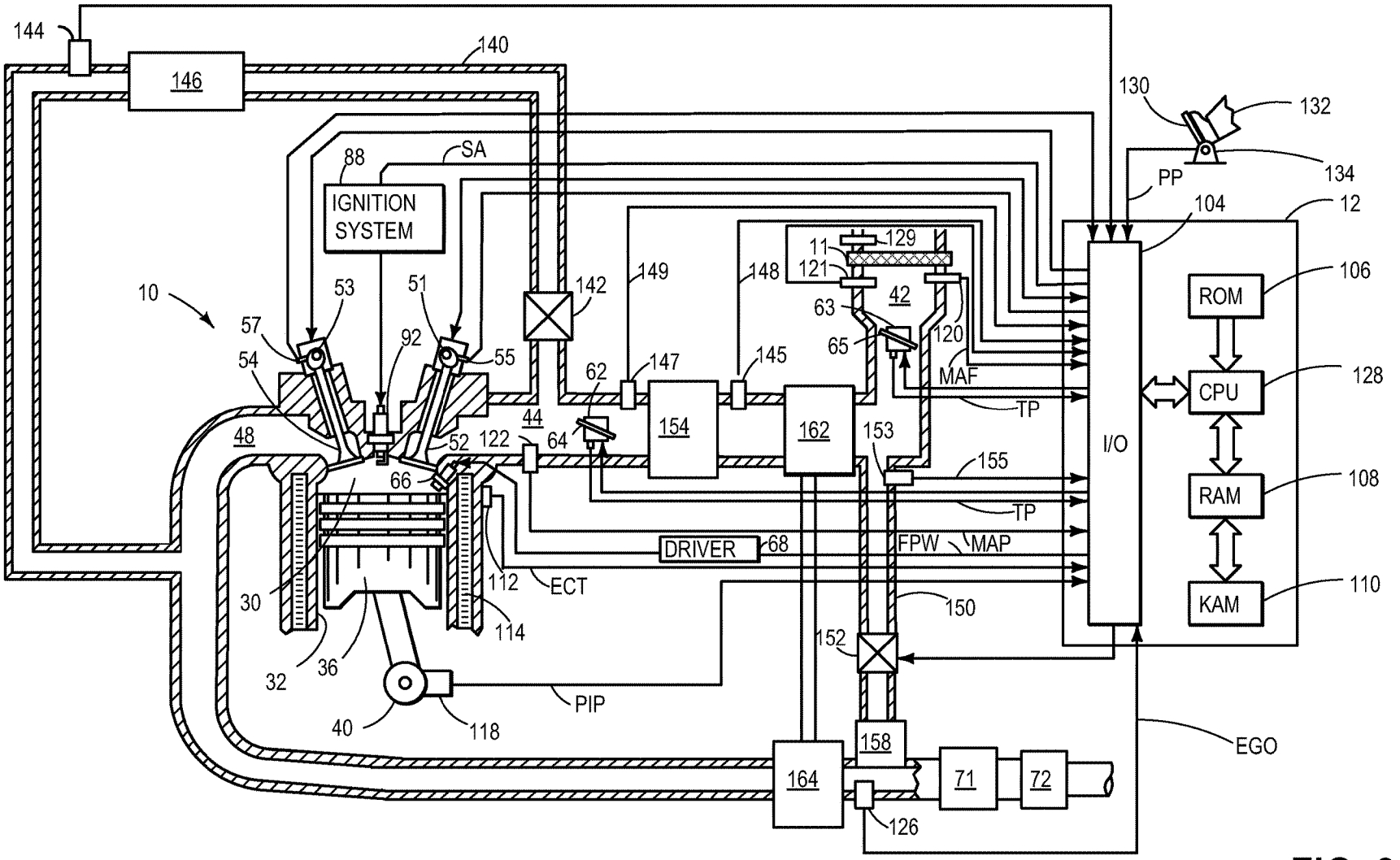
FIG. 2 shows a schematic diagram of an embodiment of an engine with a turbocharger and an exhaust gas recirculation system included in the vehicle system of FIG. 1.

The following description relates to systems and methods for estimating ambient humidity based on a wet bulb temperature and a dry bulb temperature in a vehicle system, such as the system of FIG. 1 including an engine system, such as the engine system of FIG. 2. In response to detecting precipitation, a controller may be configured to perform a control routine such as the example routine of FIG. 3 to estimate ambient humidity based on wet bulb and dry bulb temperatures. In response to not detecting precipitation, a controller may be configured to perform a control routine such as the example routine of FIG. 4 to estimate ambient humidity based on dry bulb temperature and not based on wet bulb temperature. Precipitation may be detected as elaborated at FIG. 5. An example detection of rain and humidity estimation based on dry bulb and wet bulb temperatures according to the present disclosure is shown at FIG. 6.

Turning to FIG. 1, an example embodiment of motor vehicle 102 including a wet bulb temperature sensor 123 and a dry bulb temperature sensor 121 utilized for estimating humidity is illustrated schematically. Motor vehicle 102 may be a road automobile, among other types of vehicles. Vehicle 102 includes drive wheels 105, a passenger cabin 119, a windshield 101, side view mirrors 103, a climate control system 109, and an internal combustion engine 10. Internal combustion engine 10 includes a combustion chamber (not shown) which may receive intake air via an intake passage 42 and may exhaust combustion gases via exhaust passage (not shown).

Intake passage may include an air cleaner 11 for filtering intake air and dry bulb temperature sensor 121 for measuring a temperature of intake air. In the illustrated example, dry bulb temperature sensor 121 is shown to be located downstream of the air cleaner 11. In some examples, dry bulb temperature sensor 121 may be located on an exterior surface of the vehicle 102 and shielded from weather elements. For example, the dry bulb temperature sensor 121 may be located such that it is not exposed to weather conditions such as rain, snow etc. in the air surrounding the vehicle. The sensor 121 may be located on an exterior surface of the vehicle body, by yet only partially enclosed or blocked by another vehicle body component so that it is shielded from weather elements. For example, an additional body element may be positioned vertically above the sensor, yet leave the sensor open to ambient environmental air. In one example, sensor 121 may be located inside one or more side view mirrors 103 protected from weather elements but exposed to ambient air.

Motor vehicle 102 further includes a grille shutter system 115 providing an opening (e.g., a grille opening, a bumper opening, etc.) for receiving ambient air flow 117 through or near the front end of the vehicle and into the engine. Grille shutter system 115 includes one or more grille shutters 111 and a grille 113. Grille shutters 111 may be configured to adjust the amount of air flow received through grille 113. Grille shutters 111 may cover a front region of the vehicle spanning from just below the hood to the bottom of the bumper, for example. In some embodiments, all grille shutters may be moved in coordination by the controller. In other embodiments, grille shutters may be divided into sub-regions and the controller may adjust opening/closing of each region independently. Each sub-region may contain one or more grille shutters. Grille shutters 111 are movable between an opened position and a closed position, and may be maintained at either position or a plurality of intermediate positions thereof. By adjusting different engine controls or operating parameters, such as grille shutter opening and electric fan operation, the controller may adjust an efficiency of a charge air cooler (CAC—not shown).

Wet bulb temperature sensor 123 may measure a wet bulb temperature which may be utilized along with dry bulb temperature to estimate ambient humidity during ambient weather conditions such as rain, for example. The wet bulb temperature may be a temperature of precipitation in the air surrounding the vehicle. Precipitation may one or more of rain, fog, snow, freezing rain, hail, mist, etc. Wet bulb temperature sensor 123 may be located on an exterior surface of the vehicle and may be exposed to weather elements and not exposed to an internal compartment of the vehicle, such that the sensor is exposed only to ambient conditions exterior to the vehicle, where the exterior surface is an outer-most exterior surface of the vehicle body and not enclosed by any other vehicle components. For example, wet bulb temperature sensor 123 may be located at base of windshield 101 as indicated in the illustrated example of FIG. 1. Wet bulb temperature sensor 123 may be exposed to precipitation and may measure a temperature of precipitation. In another example, the wet bulb temperature sensor may be located on grille 113 of grille shutter system 115. In yet another example, the wet bulb temperature sensor may be located on one or more side view mirrors 103. In still another example, more than one wet bulb temperature sensor may be located at different locations (such as base of the windshield, on the side view mirrors, on the grille etc.) on the exterior surface of the vehicle. When more than one wet bulb temperature sensor is used, an average of all the wet bulb temperature sensor measurements may be utilized to estimate wet bulb temperature.

FIG. 1 further shows a control system 14 of vehicle 102. Control system 14 may be communicatively coupled to various components of engine 10 and climate control system 109 to carry out the control routines and actions described herein. As shown in FIG. 1, control system 14 may include an electronic digital controller 12. Controller 12 may be a microcomputer, including a microprocessor unit, input/output ports, an electronic storage medium for executable programs and calibration values, random access memory, keep alive memory, and a data bus.

As depicted, controller 12 may receive input from a plurality of sensors 116, which may include user inputs and/or sensors (such as barometric pressure, transmission gear position, transmission clutch position, gas pedal input, brake input, transmission selector position, vehicle speed, engine speed, mass airflow through the engine, ambient temperature, intake air temperature, dry bulb temperature, wet bulb temperature etc.), climate control system sensors (such as coolant temperature, adsorbent temperature, fan speed, passenger compartment temperature, desired passenger compartment temperature, ambient humidity, etc.), and others.

Further, controller 12 may communicate with various actuators 124, which may include engine actuators (such as fuel injectors, an electronically controlled intake air throttle plate, spark plugs, transmission clutches, etc.), climate control system actuators (such as air handling vents and/or diverter valves, valves controlling the flow of coolant, blower actuators, fan actuators, etc.), and others. In addition, controller 12 may receive data from the GPS 34 and/or an in-vehicle communications and entertainment system 26 of vehicle 102.

The in-vehicle communications and entertainment system 26 may communicate with a wireless communication device 41 via various wireless protocols, such as wireless networks, cell tower transmissions, and/or combinations thereof. Data obtained from the in-vehicle communications and entertainment system 26 may include real-time and forecasted weather conditions. Weather conditions, such as temperature, precipitation (e.g., rain, snow, hail, etc.), and humidity, may be obtained through various wireless communication device applications and weather-forecasting websites. Data obtained from the in-vehicle communications and entertainment system may include current and predicted weather conditions for the current location, as well as future locations along a planned travel route.

In some embodiments, the presence of rain may be inferred from other signals or sensors (e.g., rain sensors). In one example, rain may be inferred from a vehicle windshield wiper on/off signal. Specially, in one example, when the windshield wipers are on, a signal may be sent to controller 12 to indicate precipitation such as rain, fog, snow, freezing rain, hail, etc. The controller may use this information to estimate intake air humidity. For example, when rain is indicated, the controller may estimate intake air humidity based on dry bulb and wet bulb temperatures. Details of humidity determination will be further elaborated with respect to FIGS. 3-6.

In one example, precipitation in an ambient environment of vehicle 102 may be inferred based on a difference between dry bulb and wet bulb temperatures greater than a threshold difference, and a dry bulb temperature. Further, when dry bulb temperature is between 0 degree Celsius and −3 degrees Celsius, conditions may be favorable for formation of black ice on road. When dry bulb temperature is below −3 degrees Celsius, conditions may be favorable for precipitation such as snow, freezing rain, and/or hail.

Further, the control system may be communicatively coupled to an off-board network (not shown) such as a cloud computing system via wireless communication, which may be Wi-Fi, Bluetooth, a type of cellular service, or a wireless data transfer protocol. As such, this connectivity where data from the vehicle is uploaded, also referred to as the "cloud", may be a commercial server or a private server where the data is stored and then acted upon by optimization algorithms. The algorithm may process data from a single vehicle, a fleet of vehicles, a family of engines, a family of powertrains, or a combination thereof. In one example, driving weather conditions such as presence of fog, black-ice etc. may be determined based on dry bulb and wet bulb temperatures. The determined weather conditions may be transmitted from the vehicle to the cloud which may also receive weather information from other vehicles travelling in a specific geographic location. Based on the information received from the vehicles, the algorithms may make predictions regarding weather conditions (such as specific location of fog, or black-ice formation, for example) and distribute it to individual vehicle(s).

In one example, conditions such as fog, black ice, etc., may be communicated to an instrument cluster, or internet connected devices such as accessory protocol interface module (SYNC), telematics control unit (TCU) and/or cell phone passport module (CPPM) to warn the driver and to activate emergency systems via internet such as an emergency response activation (ERA) system, a traveler information system, traveler advisory system, traffic operations centers, road crews, intelligent snow plow system, etc.

Turning to FIG. 2, it shows a schematic diagram of one cylinder of multi-cylinder engine 10, which may be included in a vehicle system, such as the vehicle system of FIG. 1. Engine 10 may be controlled at least partially by a control system including controller 12 and by input from a vehicle operator 132 via an input device 130. In this example, input device 130 includes an accelerator pedal and a pedal position sensor 134 for generating a proportional pedal position signal PP. Combustion chamber (that is, cylinder) 30 of engine 10 may include combustion chamber walls 32 with piston 36 positioned therein. In some embodiments, the face of piston 36 inside cylinder 30 may have a bowl. Piston 36 may be coupled to crankshaft 40 so that reciprocating motion of the piston is translated into rotational motion of the crankshaft. Crankshaft 40 may be coupled to at least one drive wheel of a vehicle via an intermediate transmission system. Further, a starter motor may be coupled to crankshaft 40 via a flywheel to enable a starting operation of engine 10.

Combustion chamber 30 may receive intake air from intake manifold 44 via intake passage 42 and may exhaust combustion gases via exhaust passage 48. Intake manifold 44 and exhaust passage 48 can selectively communicate with combustion chamber 30 via respective intake valve 52 and exhaust valve 54. In some embodiments, combustion chamber 30 may include two or more intake valves and/or two or more exhaust valves.

Intake valve 52 may be controlled by controller 12 via intake cam 51. Similarly, exhaust valve 54 may be controlled by controller 12 via exhaust cam 53. Alternatively, the variable valve actuator may be electric, electro hydraulic or any other conceivable mechanism to enable valve actuation. During some conditions, controller 12 may vary the signals provided to actuators 51 and 53 to control the opening and closing of the respective intake and exhaust valves. The position of intake valve 52 and exhaust valve 54 may be determined by valve position sensors 55 and 57, respectively. In alternative embodiments, one or more of the intake and exhaust valves may be actuated by one or more cams, and may utilize one or more of cam profile switching (CPS), variable cam timing (VCT), variable valve timing (VVT) and/or variable valve lift (VVL) systems to vary valve operation. For example, cylinder 30 may alternatively include an intake valve controlled via electric valve actuation and an exhaust valve controlled via cam actuation including CPS and/or VCT.

Fuel injector 66 is shown coupled directly to combustion chamber 30 for injecting fuel directly therein in proportion to the pulse width of signal FPW received from controller 12 via electronic driver 68. In this manner, fuel injector 66 provides what is known as direct injection of fuel into combustion chamber 30. The fuel injector may be mounted in the side of the combustion chamber or in the top of the combustion chamber, for example. Fuel may be delivered to fuel injector 66 by a fuel system (not shown) including a fuel tank, a fuel pump, and a fuel rail.

Ignition system 88 can provide an ignition spark to combustion chamber 30 via spark plug 92 in response to spark advance signal SA from controller 12, under select operating modes. Though spark ignition components are shown, in some embodiments, combustion chamber 30 or one or more other combustion chambers of engine 10 may be operated in a compression ignition mode, with or without an ignition spark.

Intake passage 42 may include throttles 62 and 63 having throttle plates 64 and 65, respectively. In this particular example, the positions of throttle plates 64 and 65 may be varied by controller 12 via signals provided to an electric motor or actuator included with throttles 62 and 63, a configuration that is commonly referred to as electronic throttle control (ETC). In this manner, throttles 62 and 63 may be operated to vary the intake air provided to combustion chamber 30 among other engine cylinders. The positions of throttle plates 64 and 65 may be provided to controller 12 by throttle position signals TP. Pressure, temperature, and mass air flow may be measured at various points along intake passage 42 and intake manifold 44. For example, intake passage 42 may include a mass air flow sensor 120 for measuring clean air mass flow entering through throttle 63, and a barometric pressure sensor 129 for measuring barometric pressure. The clean air mass flow may be communicated to controller 12 via the MAF signal. Further, intake passage 42 may include an air cleaner 11 (also herein referred to as air filter) for filtering intake air and thereby providing clean air mass flow. Intake passage 42 may also include a dry bulb temperature sensor 121 for measuring the temperature of intake air (that is, dry bulb temperature). The temperature and pressure signals from the temperature and pressure sensors may be communicated to the controller. In one example, the dry bulb temperature may be utilized to estimate humidity (e.g., ambient humidity). The estimated humidity may be utilized to adjust a MAF estimate.

Engine 10 may further include a compression device such as a turbocharger or supercharger including at least a compressor 162 arranged upstream of intake manifold 44. For a turbocharger, compressor 162 may be at least partially driven by a turbine 164 (e.g., via a shaft) arranged along exhaust passage 48. For a supercharger, compressor 162 may be at least partially driven by the engine and/or an electric machine, and may not include a turbine. Thus, the amount of compression provided to one or more cylinders of the engine via a turbocharger or supercharger may be varied by controller 12. A charge air cooler 154 may be included downstream from compressor 162 and upstream of intake valve 52. Charge air cooler 154 may be configured to cool gases that have been heated by compression via compressor 162, for example. In one embodiment, charge air cooler 154 may be upstream of throttle 62. Pressure, temperature, and mass air flow may be measured downstream of compressor 162, such as with sensor 145 or 147. The measured results may be communicated to controller 12 from sensors 145 and 147 via signals 148 and 149, respectively. Pressure and temperature may be measured upstream of compressor 162, such as with sensor 153, and communicated to controller 12 via signal 155. In one example, an efficiency of the compressor may be determined based on pressures and temperatures measured upstream and downstream of the compressor, and specific heat ratio Cp/Cv. When intake air humidity is known, the efficiency of the compressor may be determined with higher accuracy.

Further, in the disclosed embodiments, an exhaust gas recirculation (EGR) system may route a desired portion of exhaust gas from exhaust passage 48 to intake manifold 44. FIG. 1 shows a high pressure EGR (HP-EGR) system and a low pressure EGR (LP-EGR) system, but an alternative embodiment may include only an LP-EGR system. The HP-EGR is routed through HP-EGR passage 140 from upstream of turbine 164 to downstream of compressor 162. The amount of HP-EGR provided to intake manifold 44 may be varied by controller 12 via HP-EGR valve 142. The LP-EGR is routed through LP-EGR passage 150 from downstream of turbine 164 to upstream of compressor 162. The amount of LP-EGR provided to intake manifold 44 may be varied by controller 12 via LP-EGR valve 152. The HP-EGR system may include HP-EGR cooler 146 and the LP-EGR system may include LP-EGR cooler 158 to reject heat from the EGR gases to engine coolant, for example.

Under some conditions, the EGR system may be used to regulate the temperature of the air and fuel mixture within combustion chamber 30. Thus, it may be desirable to measure or estimate the EGR mass flow. EGR sensors may be arranged within EGR passages and may provide an indication of one or more of mass flow, pressure, temperature, concentration of $O_2$, and concentration of the exhaust gas. For example, an HP-EGR sensor 144 may be arranged within HP-EGR passage 140.

In some embodiments, one or more sensors may be positioned within LP-EGR passage 150 to provide an indication of one or more of a pressure, temperature, and air-fuel ratio of exhaust gas recirculated through the LP-EGR passage. Exhaust gas diverted through LP-EGR passage 150 may be diluted with fresh intake air at a mixing point located at the junction of LP-EGR passage 150 and intake passage 42. Specifically, by adjusting LP-EGR valve 152 in coordination with first air intake throttle 63 (positioned in the air intake passage of the engine intake, upstream of the compressor), a dilution of the EGR flow may be adjusted.

A percent dilution of the LP-EGR flow may be inferred from the output of a sensor 145 in the engine intake gas stream. Specifically, sensor 145 may be positioned downstream of first intake throttle 63, downstream of LP-EGR valve 152, and upstream of second main intake throttle 62, such that the LP-EGR dilution at or close to the main intake throttle may be accurately determined. Sensor 145 may be, for example, an oxygen sensor such as a UEGO sensor.

A dew point temperature of the EGR gas may be estimated based on the humidity of intake air. The estimated dew point temperature maybe utilized to adjust EGR cooler such that condensation at the EGR cooler may be reduced. Further, a dew point temperature of a mixture of the EGR gas and the intake air may be estimated. Based on the dew point temperature of the mixture of exhaust gas and intake air, EGR cooler may be utilized to adjust a temperature of EGR gas so as to reduce condensation when the EGR gas and the intake air combine. Exhaust gas sensor 126 is shown coupled to exhaust passage 48 downstream of turbine 164. Sensor 126 may be any suitable sensor for providing an indication of exhaust gas air/fuel ratio such as a linear oxygen sensor or UEGO (universal or wide-range exhaust gas oxygen), a two-state oxygen sensor or EGO, a HEGO (heated EGO), a $NO_x$, HC, or CO sensor.

Emission control devices 71 and 72 are shown arranged along exhaust passage 48 downstream of exhaust gas sensor 126. Devices 71 and 72 may be a selective catalytic reduction (SCR) system, three way catalyst (TWC), $NO_x$ trap, various other emission control devices, or combinations thereof. For example, device 71 may be a TWC and device 72 may be a particulate filter (PF). In some embodiments, PF 72 may be located downstream of TWC 71 (as shown in FIG. 1), while in other embodiments, PF 72 may be positioned upstream of TWC 72 (not shown in FIG. 1).

Controller 12 is shown in FIG. 2 as a microcomputer, including microprocessor unit 128, input/output ports 104, an electronic storage medium for executable programs and calibration values shown as read only memory chip 106 in this particular example, random access memory 108, keep alive memory 110, and a data bus. Controller 12 may receive various signals from sensors coupled to engine 10, in addition to those signals previously discussed, including measurement of dry bulb temperature from dry bulb temperature sensor 121 (TDB), measurement of wet bulb temperature from wet bulb temperature sensor (not shown) (TWB), measurement of inducted mass air flow (MAF) from mass air flow sensor 120; engine coolant temperature (ECT) from temperature sensor 112 coupled to cooling sleeve 114; a profile ignition pickup signal (PIP) from Hall effect sensor 118 (or other type) coupled to crankshaft 40; throttle position (TP) from a throttle position sensor; and absolute manifold pressure signal, MAP, from sensor 122. Engine speed signal, RPM, may be generated by controller 12 from signal PIP. Manifold pressure signal MAP from a manifold pressure sensor may be used to provide an indication of vacuum, or pressure, in the intake manifold. Note that various combinations of the above sensors may be used, such as a MAF sensor without a MAP sensor, or vice versa. During stoichiometric operation, the MAP sensor can give an indication of engine torque. Further, this sensor, along with the detected engine speed, can provide an estimate of charge (including air) inducted into the cylinder. In one example, sensor 118, which is also used as an engine speed sensor, may produce a predetermined number of equally spaced pulses every revolution of the crankshaft.

Storage medium read-only memory 106 can be programmed with computer readable data representing instructions executable by processor 128 for performing the methods described below as well as other variants that are anticipated but not specifically listed.

As described above, FIG. 2 shows only one cylinder of a multi-cylinder engine, and that each cylinder may similarly include its own set of intake/exhaust valves, fuel injector, spark plug, etc.

The systems of FIGS. 1-2 may provide for a system for a vehicle comprising: an engine, a dry bulb temperature sensor measuring a dry bulb temperature and located at an exterior surface of the vehicle and not exposed to weather; a wet bulb temperature sensor measuring a wet bulb temperature, the wet bulb temperature sensor located at an exterior surface of the vehicle and exposed to weather; and a controller with computer readable instructions for estimating ambient humidity based on the dry bulb temperature and the wet bulb temperature in response to rain, and adjusting one or more engine operating parameters based on the estimated humidity. In one example, the dry bulb temperature sensor may be located in an intake passage of the vehicle and the wet bulb temperature sensor may be located at a base of a windshield of the vehicle. Additionally or alternatively, the wet bulb temperature sensor may be located on one or more side view mirrors, on a grille, etc. Further, in one example, such action of estimating humidity is taken only in response to detected rain from sensors or information other than from the wet and/or dry temperature sensors.

Figure 3:
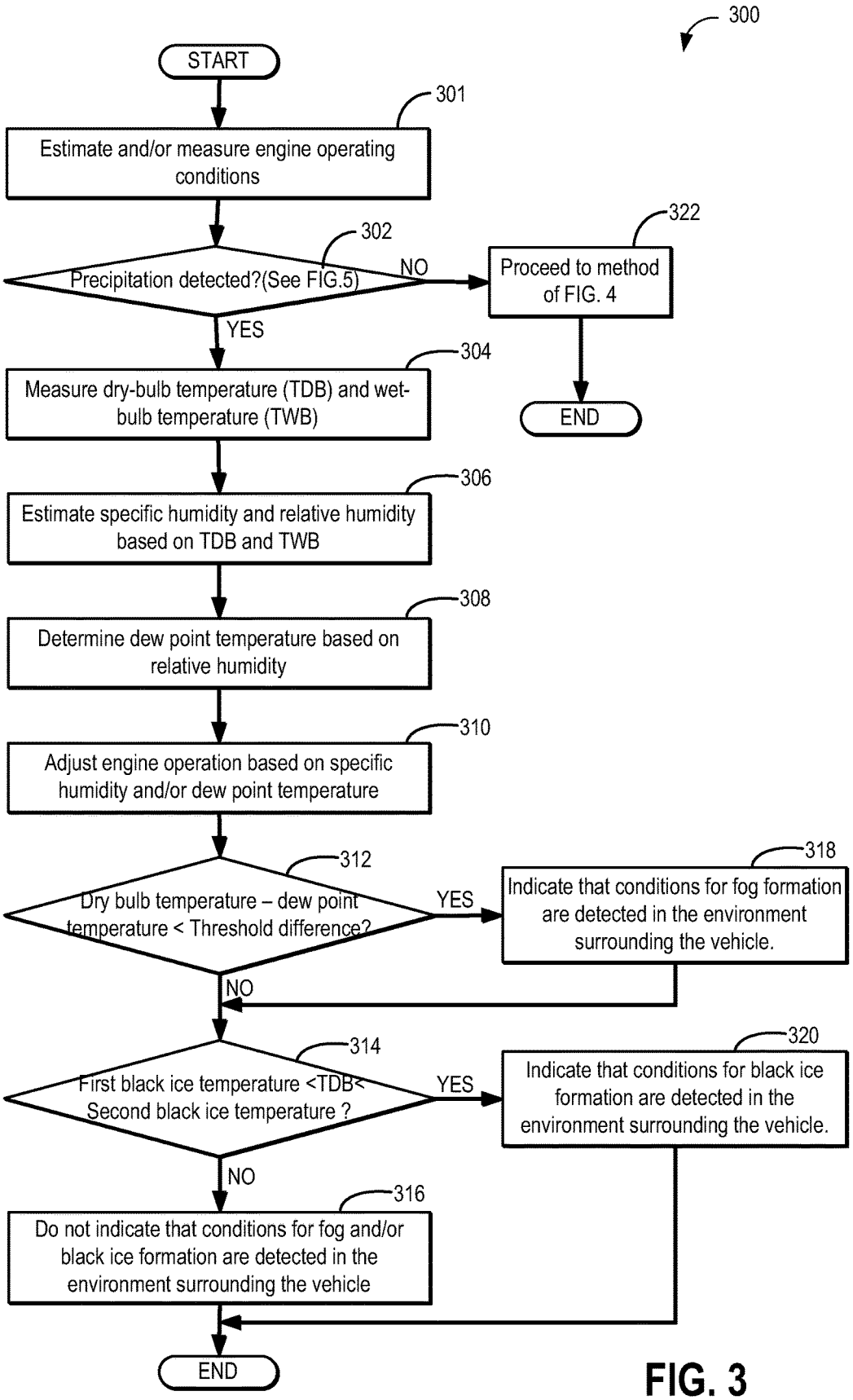
FIG. 3 shows a flow chart illustrating a method for estimating ambient humidity based on a dry bulb temperature and a wet bulb temperature.
Figure 4:
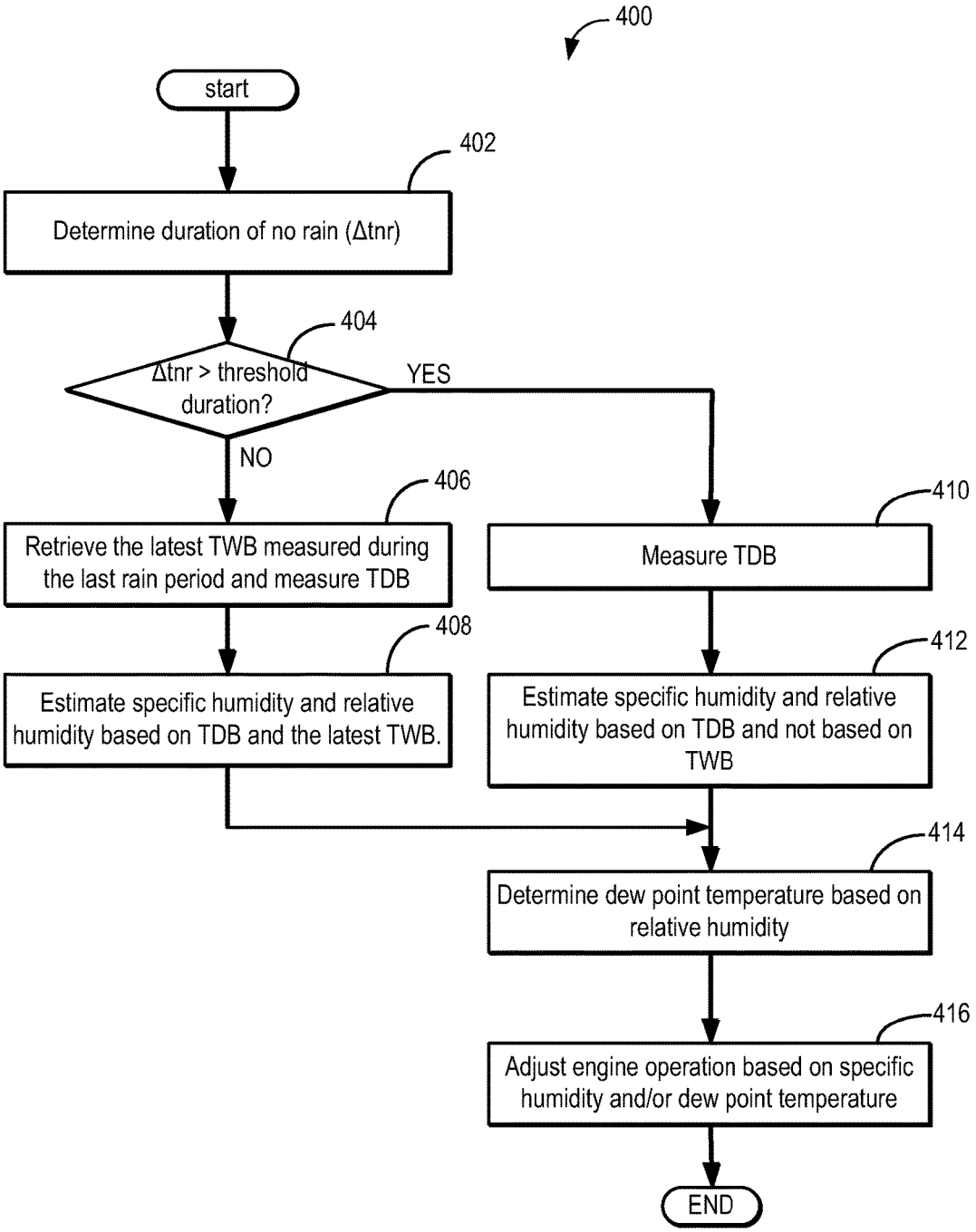
FIG. 4 shows a flow chart illustrating a method for estimating ambient humidity during conditions when rain is absent.

FIGS. 3 and 4 depict methods for estimating ambient humidity based on a dry bulb temperature and/or a wet bulb temperature in response to a rain condition in an environment surrounding a vehicle, such as the vehicle of FIG. 1. The humidity may be specific humidity and/or relative humidity, for example. The rain condition may be based on presence or absence of rain. Specifically, FIG. 3 shows a routine 300 for estimating humidity upon detecting rain, and FIG. 4 shows a routine 400 for estimating humidity when rain is not detected. In one example, a controller, such as controller 12 shown at FIGS. 1 and 2, may execute routines 300 and 400 based on instructions stored thereon.

Turning first to method 300, at 301, the controller may estimate and/or measure engine operating conditions. The engine operating conditions may include one or more of an ON/OFF signal from windshield wipers, a wet bulb temperature from a wet bulb temperature sensor, a dry bulb temperature from a dry bulb temperature sensor, a barometric pressure, a charge air cooler (CAC) cooling efficiency, a windshield wiper duty cycle, engine speed, load, air-fuel ratio (AFR), etc. Next, at 302, the controller may determine if precipitation (e.g., rain) is detected in an environment surrounding the vehicle. Rain or another type of moisture in the surrounding environment may be determined based on wet bulb and dry bulb temperatures. Details of detecting rain (or precipitation such as fog, mist, hail, freezing rain, snow, etc.) based on wet bulb and dry bulb temperatures will be further elaborated at FIG. 5. Additionally or alternatively, other methods may be utilized to infer the rain condition. In one example, efficiency of a CAC may be used to infer the presence of precipitation. For example, condensate formation may increase during high humidity conditions, such as rain. This is a result of the rain/humidity increasing the cooling efficiency of the CAC. Thus, CAC efficiency may be used to infer the presence of rain and high humidity. In another example, windshield wiper speed may also indicate precipitation and be used to infer high humidity conditions. For example, the windshield wiper on/off signal may indicate the presence of precipitation (e.g., when the windshield wipers are on and operating, precipitation may be indicated). In still another example, vehicles may also be equipped with rain sensors coupled to the wiper motor where wiper motor speed is a function of rain intensity and may also be used to determine rain conditions.

If rain or moisture in the air is detected at 302, the routine may proceed to step 304. At 304, the controller may determine the wet bulb temperature and the dry bulb temperature based on measurements from the wet bulb temperature sensor and the dry bulb temperature sensor. Wet bulb temperature is the temperature of precipitation (such as rain, for example) measured by the wet bulb temperature sensor (such as wet bulb temperature sensor 123 shown in FIG. 1), and dry bulb temperature is the temperature of ambient air measured by the dry bulb temperature sensor (such as dry bulb temperature sensor 121 shown in FIGS. 1-2).

The wet bulb temperature sensor may be a wet bulb thermometer positioned on an exterior surface of the vehicle and measuring a temperature of precipitation in an environment surrounding the vehicle. The precipitation may be in form of rain, for example. In one example, wet bulb thermometer may be located at a base of a windshield of a vehicle (such as windshield 101 of vehicle 102 at FIG. 1). In another example, the wet bulb thermometer may be located on one or more side view mirrors of the vehicle (such as side view mirrors 103 at FIG. 1). In still another example, the wet bulb thermometer may be positioned on a grille of a grille system of the vehicle (such as grille system 115 at FIG. 1). In this way, one or more wet bulb thermometers may be positioned on an exterior surface of the vehicle so as to enable measurement of temperature of precipitation in the environment surrounding the vehicle.

The dry bulb temperature sensor may be a dry bulb thermometer located in the intake manifold of the vehicle and measuring a temperature of intake air. In one example, dry bulb thermometer may be located on an exterior surface of a vehicle such as vehicle 102 at FIG. 1. When located on the exterior surface, the dry bulb thermometer may be shielded from weather (e.g., shielded from precipitation (such as rain, for example) and moisture).

Next, at 306, upon determining the dry bulb and wet bulb temperatures, the controller may estimate specific humidity of the intake air based on the wet bulb and dry bulb temperatures. For example, the controller may utilize a psychrometric interpolation table stored thereon to estimate specific humidity of intake air (e.g., stored as a look-up table). Further at 306, relative humidity of intake air may be estimated based on dry bulb and wet bulb temperatures by utilizing the psychrometric interpolation table. As such, the psychrometric interpolation table may map the dry bulb temperature, wet bulb temperature, and barometric pressure values to corresponding estimates of specific humidity and relative humidity of intake air.

Next, at 308, the controller may determine a dew point temperature of the intake air based on the estimated relative humidity. For example, the controller may utilize the psychrometric interpolation table or a second look-up table stored in the controller to determine the dew point temperature of the intake air based on the measured wet bulb temperature, measured dry bulb temperature, and estimated relative humidity.

Upon estimating the specific humidity and dew point temperature of the intake air, the routine may proceed to 310. At 310, the controller may adjust one or more engine operating parameters based on the estimated specific humidity and dew point temperature. The one or more engine operating parameters may include EGR flow, spark timing, air-fuel ratio, and variable cam timing, among others. For example, engine operation may be adjusted to maintain desired combustion conditions, and/or reduce combustion instability. Additionally, engine operation may be adjusted to provide desired climate control (desired temperature and humidity of the vehicle cabin) based on the estimated humidity and dew point temperature. In some examples, only one parameter may be adjusted in response to the humidity. In other examples, any combination or sub-combination of these operating parameters may be adjusted in response to the estimated intake air humidity.

In one embodiment, an amount of exhaust gas recirculation (EGR) may be adjusted based on estimated intake air specific humidity. For example, in response to a change in estimated intake air humidity, EGR flow may be increased or decreased in at least one combustion chamber. Specifically, upon detecting an increase in specific humidity, EGR flow into at least one combustion chamber may be reduced. As such, the EGR flow may be increased or decreased in only one combustion chamber, in some combustion chambers, or in all combustion chambers. Furthermore, the magnitude of change of the EGR flow may be the same for all cylinders or the magnitude of change of the EGR flow may vary by cylinder based on the specific operating conditions of each cylinder.

In another embodiment that includes a spark-ignition engine, spark timing may be adjusted responsive to the estimated intake air humidity. In at least one condition, for example, spark timing may be advanced in one or more cylinders during subsequent engine fueling operation responsive to a higher humidity. Spark timing may be scheduled so as to reduce knock in low humidity conditions (e.g., retarded from a peak torque timing), for example. When an increase in humidity is detected, spark timing may be advanced in order to maintain engine performance and operate closer to or at a peak torque spark timing.

Additionally, spark timing may be retarded in response to a decrease in estimated intake air humidity. For example, a decrease in estimated intake air humidity from a higher humidity may cause knock. If the decrease in humidity is detected, spark timing may be retarded and knock may be reduced. It should be noted that spark may be advanced or retarded in one or more cylinders. Further, the magnitude of change of spark timing may be the same for all cylinders or one or more cylinders may have varying magnitudes of spark advance or retard.

In a further embodiment, variable cam timing (VCT), and thus valve timing, may be adjusted during subsequent engine fueling operation based on the estimated intake air humidity. Camshaft timing may be set for optimal fuel economy and emissions corresponding to a low ambient humidity, for example. In order to maintain optimal fuel economy and emissions and prevent engine misfire, camshaft timing may be adjusted for one or more cylinder valves in response to an increase or decrease in estimated intake air humidity. Depending on the current VCT schedule and the time of cam timing adjustment, various combinations of valves may be adjusted; for example, one or more exhaust valves, one or more intakes valves, or a combination of one more intake valves and one or more exhaust valves may be adjusted. Furthermore, VCT may be adjusted in a similar manner responsive to a decrease in estimated intake air humidity.

In still another embodiment, exhaust gas air-fuel ratio may be adjusted responsive to the estimated intake air humidity. For example, an engine may be operating with a lean air-fuel ratio optimized for low humidity. In the event of an increase in humidity, the mixture may become diluted, resulting in engine misfire. If an increase in humidity is detected however, the AFR may be adjusted so that the engine will operate with a smaller degree of leanness, e.g., a less lean AFR than when humidity is low, but still a lean air-fuel ratio. Likewise, an AFR may be adjusted to be a larger degree of leanness, e.g., a more lean, lean air-fuel ratio in response to a decrease in estimated intake air humidity. In this way, conditions such as engine misfire due to humidity fluctuations may be reduced.

In some embodiments, an engine may be operating with a stoichiometric air-fuel ratio or a rich air-fuel ratio. As such, the AFR may be independent of ambient humidity and fluctuations in humidity may not result in an adjustment of AFR.

In some other embodiments, intake air humidity may be utilized to estimate an amount of feed gas NOx with increased accuracy. In still another embodiment, in order to maintain accurate control of an injected reductant, such as urea, ammonia sensors may be recalibrated based on specific humidity. As such, ammonia reading from the sensor may vary depending on ambient humidity.

In yet another embodiment, dew point temperature of EGR may be modelled based on intake specific humidity. Engine control strategies such as decreasing EGR flow or shutting-off EGR may be employed in response to a temperature of EGR gas approaching the dew point temperature or decreasing below the dew point temperature to prevent condensation in the EGR system. In yet another embodiment, charge air cooling at the CAC may be adjusted based on the estimated dew point temperature of intake air and/or the estimated humidity. For example, as the estimated humidity increases, condensate may form within the CAC. Thus, cooling to the CAC may be decreased as the estimated humidity increases. For example, in response to the humidity estimated by method 300 increasing, the controller may adjust a position of the grille shutters (e.g., decrease an opening of the grille shutters), adjust operation of an engine cooling fan (e.g., decrease cooling provided by the fan), and/or decrease a flow of coolant to a water-cooled CAC in order to decrease the cooling efficiency of the CAC.

In some examples, during certain weather conditions such as during cold weather conditions and during idle or no load driving conditions, EGR cooling may not be desired. For example, when EGR is cooled below the dew point temperature condensate may form in the EGR system. The condensate may mix with the exhaust containing sulfur and nitrogen compounds producing acids that may corrode the EGR system as well as other components of the engine. Therefore, in order to prevent condensate formation, EGR cooler may be bypassed.

In another embodiment, intake air specific humidity may be utilized to adjust engine operating parameters in an engine operating in a homogeneous charge compression ignition mode. For example, based on intake air humidity, an initial charge temperature may be adjusted to adjust the timing of auto-ignition.

In this way, engine operating parameters may be adjusted responsive to estimated intake air specific humidity generated based on output from a wet bulb temperature sensor and a dry bulb temperature sensor in the presence of rain or increased moisture. As such, intake air humidity may be estimated frequently and one or more engine operating parameters may be adjusted accordingly, resulting in an optimized overall engine performance despite fluctuations in humidity.

In addition to adjusting engine operation, the dry bulb and wet bulb temperatures may be utilized to predict fog and black ice formation in the environment surrounding the vehicle. Returning to FIG. 3, at 312 the controller may determine if a difference between the ambient air temperature (that is, dry bulb temperature) and dew point temperature is less than a threshold difference. In one example, the threshold difference for fog formation may be 2.5 degree Celsius. If yes, at 318, the controller may indicate that conditions for fog formation are present in the environment surrounding the vehicle. Returning to 312, upon determining that conditions for fog formation are detected, next, at 314, the controller may determine if the ambient air temperature is between a first black ice temperature and a second black ice temperature. In one example, the first black ice temperature may be −3 degree Celsius and the second black ice temperature may be 0 degree Celsius. During these conditions, water droplets may be supercooled and may freeze upon contact with a road surface at temperature below a threshold road temperature resulting in black ice formation. Upon determining that the ambient temperature is between the first and the second black ice temperature range, the controller may indicate (at 320) that conditions for black ice formation may be present in the environment surrounding the vehicle. For example, upon determination of weather conditions such as fog and black ice, a vehicle driver may be notified of adverse weather conditions and be advised to take precautionary actions. As such, the controller may set a diagnostic code and/or activate a visual indicator indicating black ice and/or fog. In one example, fog lights may be turned on automatically upon detecting conditions for fog formation.

In some examples, information for determination of fog and black ice formation may be transmitted from a vehicle controller to a real-time global information system (GIS) operating in a vehicular mobile network such as a cloud computing system via a wireless network system. As such, the vehicular mobile network may receive information (such as dry bulb temperature, wet bulb temperature, ambient humidity, dew point temperature, etc.) from one or more vehicles connected to the mobile network, predict weather conditions (such as fog, black ice formation, etc.) based on the information received, and transmit the predictions to the vehicles in the network.

In one example, when conditions that favor fog formation are present, water droplets may accumulate in the inlet air filter at low MAF. During these conditions, a sudden increase in MAF may draw a mist of water into the intake air causing the engine to misfire. For example engine may misfire due to sudden increase in MAF that may occur when a vehicle pulls out of a line of vehicles to pass on a two-way road, resulting in significant safety hazard. Engine misfires due to the sudden increase in MAF may be mitigated by recalibrating the engine based on humidity during fog conditions. In this way, by detecting precipitation (such as fog) based on dry bulb and wet bulb temperatures, and adjusting humidity based on the detected precipitation, engine misfires may be reduced.

In some embodiments, in addition to wet bulb and dry bulb temperatures, fog may be determined based on a vehicle pyrometer used to determine changes in relative intensity of light.

If conditions for fog and black ice are not detected in the environment surrounding the vehicle, the controller may not indicate that conditions for fog and black ice formation are detected in the environment surrounding the vehicle, and routine 300 may end.

Returning to 302, if rain is not inferred at 302, the routine may proceed to 322. At 322, the controller may execute routine 400 of FIG. 4 to estimate humidity when rain is not detected.

In one example, the dew point temperature may be utilized to determine fogging conditions on an external surface of a window and/or windshield glass during rainy conditions. For example, fogging may be determined based on a temperature difference between the wet bulb temperature and a vehicle cabin temperature, ambient humidity, dew point temperature of the ambient air, and temperature of the external surface of the window and/or the windshield glass. Fogging may occur above −3 degree Celsius, and when the temperature of the external surface of the glass is at or below the dew point temperature. The temperature of the glass may be determined based thermal modeling or based on direct measurement. For example, during precipitation, forward facing glass surfaces are in contact with precipitation. Therefore, forward facing window and/or windshield glass temperature may be at the wet bulb temperature. Backward facing glass may not be exposed to precipitation when the vehicle is moving, so the glass temperature may be determined based on thermal modeling. Direct measurement of glass temperature and thermal modeling to determine glass temperature may be used during conditions when the vehicle may pass through a tunnel where the air is cold at one end and warm at the other; or when the vehicle is travelling downhill, etc.

Upon determining window and/or windshield fogging, vehicle climate control parameters such as temperature, air flow, and humidity of the vehicle may be adjusted to reduce fogging.

In this way, in response to detecting precipitation, ambient humidity may be estimated based on dry bulb and wet bulb temperatures, the dry and wet bulb temperatures measured from corresponding dry and wet bulb thermometers attached to the vehicle. As such, during onset of rain, a sudden increase in intake air humidity may occur. By utilizing the wet bulb temperature (that is, temperature of rain) to estimate specific humidity during rain, change in humidity (such as the change occurring during onset of rain) may be immediately detected and a humidity value during rainy conditions may be estimated with increased accuracy. Consequently, engine operating parameters and vehicle climate control parameters may be adjusted for improved efficiency, emissions, and drivability. Additionally, wet and dry bulb temperatures may be used to determine additional weather conditions such as fog and black ice formation. Engine operation may then be adjusted based on the determined weather conditions.

Turning to FIG. 4, a method 400 for estimating ambient humidity during conditions when rain is not detected is shown. Method 400 may continue from the method at 302 shown in FIG. 3, after determining rain is not detected. The humidity may be a specific humidity value and/or a relative humidity value, for example. At 402, the controller may determine a duration of no rain ($\Delta tnr$). The duration of no rain may be determined based on a difference between a current time and a time when a change in rain condition from rain to no rain had occurred. In one example, the change in rain condition to a no rain condition may be inferred based on a change in windshield wiper signal from on to off. In another example, the change in rain condition to no rain condition may be inferred based on a change in difference between dry bulb and wet bulb temperatures from greater than a threshold difference to less than a threshold difference. In still another example, the change in rain condition to no rain condition may be inferred based on a change in efficiency of the charge air cooler.

Upon determining the duration of no rain, at 404, the controller may determine if the duration of no rain is greater than a threshold duration. The threshold duration may be based on a duration of time required for an air filter (such as air filter 11 of FIGS. 1 and 2) to dry after a recent rain event. For example, during rainy conditions, rain water may enter the intake passage through an opening in the grille. Consequently, the air filter located in the intake passage may get wet. The wetness of the air filter may contribute to the humidity of intake air. After the rain has stopped, it may take a duration of time for the air filter to dry. As a result, the air filter may still be wet from the recent rain, and the wetness of the air filter may contribute to the humidity of intake air even in the absence of rain. If the humidity is estimated based on dry bulb temperature and not based on wet bulb temperature when the air filter is still wet, the resulting humidity estimate may have decreased accuracy. Therefore, in estimating humidity, the wetness of the air filter may be considered. Upon determining that the duration of no rain is not greater than the threshold duration (e.g., time since the rain condition changed from rain present to no rain present is less than the threshold duration and thus the air filter may still contain moisture), the routine may proceed to 406. At 406, the controller may retrieve the latest wet bulb temperature measurement during the last rain period (in other words, the recent rain period) stored thereon, and measure the dry bulb temperature. Next, at 408, the controller may estimate specific humidity and relative humidity based on the measured dry bulb temperature and the retrieved (e.g., previously measured) wet bulb temperature. For example, the controller may utilize a psychrometric interpolation table stored thereon to estimate specific humidity and relative humidity of intake air. As such, the psychrometric interpolation table may map the dry bulb temperature, wet bulb temperature, and barometric pressure values into estimating specific humidity and relative humidity of intake air.

If the duration of no rain is greater than threshold, the wetness factor of the air filter may not contribute significantly to the humidity of intake air. Therefore, the routine may proceed to 410. At 410, the controller may measure a dry bulb temperature (from a dry bulb temperature sensor) and subsequently, at 412, the controller may estimate relative humidity and specific humidity based on the dry bulb temperature and not based on wet bulb temperature. That is, during conditions when there is no rain, and when it is determined that the air filter is dry, the wet bulb temperature may not be taken into consideration in estimation of humidity. In one example, when humidity is not based on wet bulb temperature, humidity may be estimated based on the dry bulb temperature, barometric pressure, and weather information from navigation systems such as GPS. In another example, humidity may be estimated based on dry bulb temperature, barometric pressure, and concentration of one or more engine-out emissions. In still another example, humidity may be estimated based on one or more sensor information sent to the controller from various humidity sensors, such as an absolute humidity sensor, a relative humidity sensor, and others.

Upon estimating the humidity based on dry bulb temperature and/or wet bulb temperature, the controller may proceed to step 414 to determine a dew point temperature based on the determined relative humidity. Upon determining the dew point temperature, at 416, the controller may adjust one or more engine operating parameters based on specific humidity and/or dew point temperature. The one or more engine operating parameters may include EGR flow, spark timing, air-fuel ratio, and variable cam timing, among others. The one or more engine operating parameters may be adjusted as discussed with respect to FIG. 3 to maintain desired combustion conditions, and/or reduce combustion instability. Additionally, the estimated humidity and dew point temperature may be used to adjust engine operating parameters in order to provide desired climate control (such as prevention of windshield fogging, adjustment of temperature and humidity of the vehicle cabin, etc.). In some examples, only one parameter may be adjusted in response to the humidity. In other examples, any combination or sub-combination of these operating parameters may be adjusted in response to the estimated humidity.

In some examples, during conditions when the duration of no rain is less than the threshold duration, the estimated humidity may be a function of the duration of no rain in addition to dry bulb and wet bulb temperatures as discussed above. For example, the wetness of the air filter may decrease as the duration of no rain increases, and consequently, humidity may decrease.

In this way, during conditions when rain is absent, the wetness factor of the air filter (e.g., amount of moisture in the air filter) may be taken into account in estimating humidity of the intake air. Upon determining that the wetness of the air filter may not contribute to the humidity, the dry bulb temperature may be utilized and the wet bulb temperature may not be utilized to estimate intake air humidity.

In one example, a method for an engine may comprise: adjusting engine operation based on an ambient specific humidity, the ambient specific humidity estimated based on a dry bulb temperature measured by a first thermometer positioned on an exterior surface of a vehicle and shielded from weather, a wet bulb temperature measured by a second thermometer positioned on the exterior surface of the vehicle and exposed to weather, and a barometric pressure in response to detecting precipitation. Adjusting operation of the engine may include one or more of adjusting a mass air flow, spark timing, variable valve timing, or exhaust gas air-fuel ratio. Further, in response to not detecting precipitation, ambient specific humidity may be estimated based on the dry bulb temperature and the wet bulb temperature when a duration of no precipitation is less than a threshold duration. When the duration of no precipitation is greater than the threshold duration, ambient specific humidity may be estimated based on the dry bulb temperature and not based on wet bulb temperature. The wet bulb temperature may be a temperature of precipitation. In one example, the second thermometer may be positioned on one of a vehicle grille shutter, side view mirror, or at a base of a windshield.

Precipitation may be detected based on one or more of a difference between the dry bulb temperature and the wet bulb temperature greater than a threshold temperature, or a windshield wiper duty cycle. Further, a psychrometric interpolation table stored within a memory of a controller of the engine may be utilized to estimate the ambient specific humidity based on the measured wet bulb temperature, the measured dry bulb temperature, and barometric pressure. Further, ambient relative humidity based on the dry bulb temperature and the wet bulb temperature, and a first dew point temperature of an exhaust gas may be determined based on the ambient relative humidity, and adjusting EGR flow based on the first dew point temperature. Still further, a second dew point temperature of ambient air may be determined based on the ambient relative humidity, and formation of fog and formation of black ice in an environment surrounding the vehicle may be estimated based on the second dew point temperature.

Figure 5:
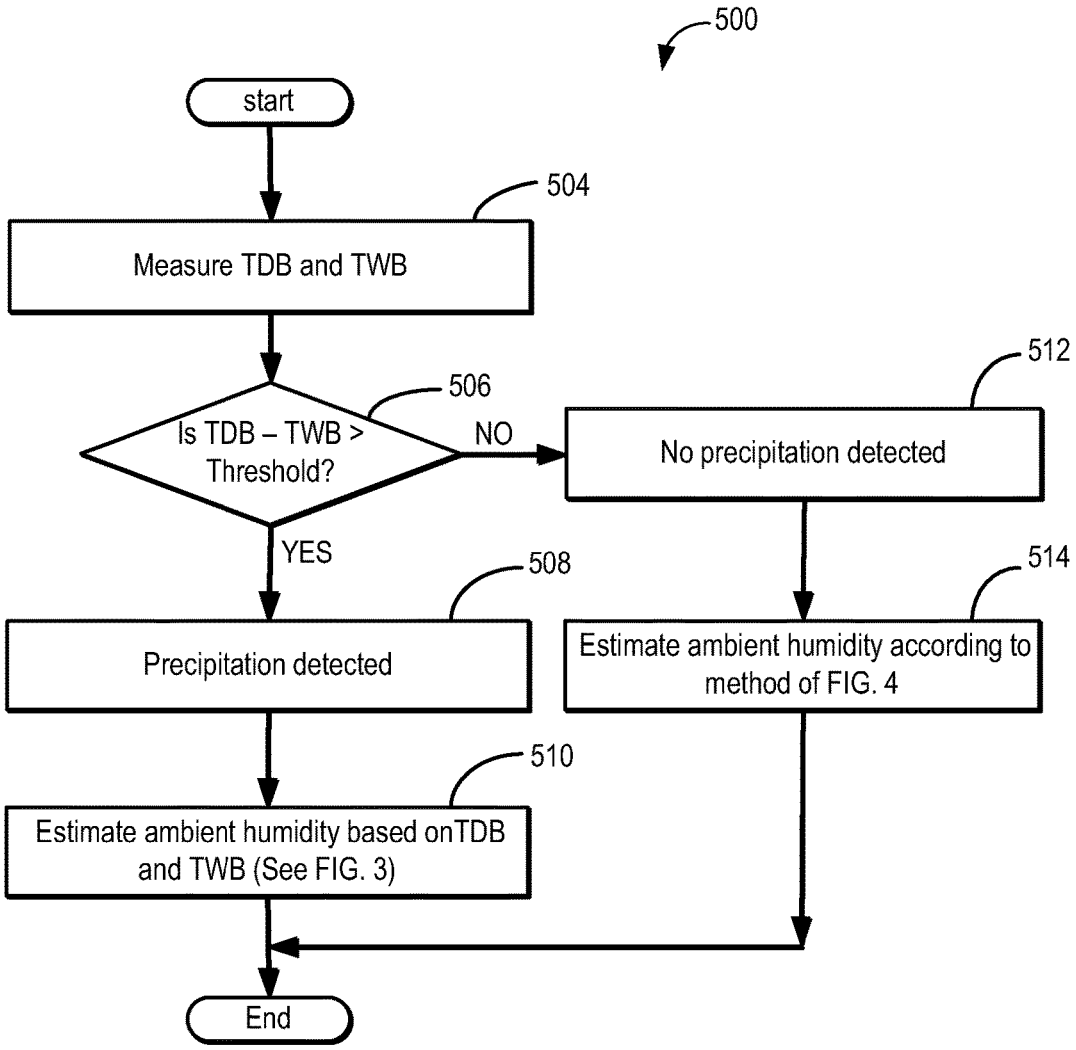
FIG. 5 shows a flow chart illustrating a method for determining presence or absence of rain utilizing the dry bulb temperature and the wet bulb temperature.
Figure 6:
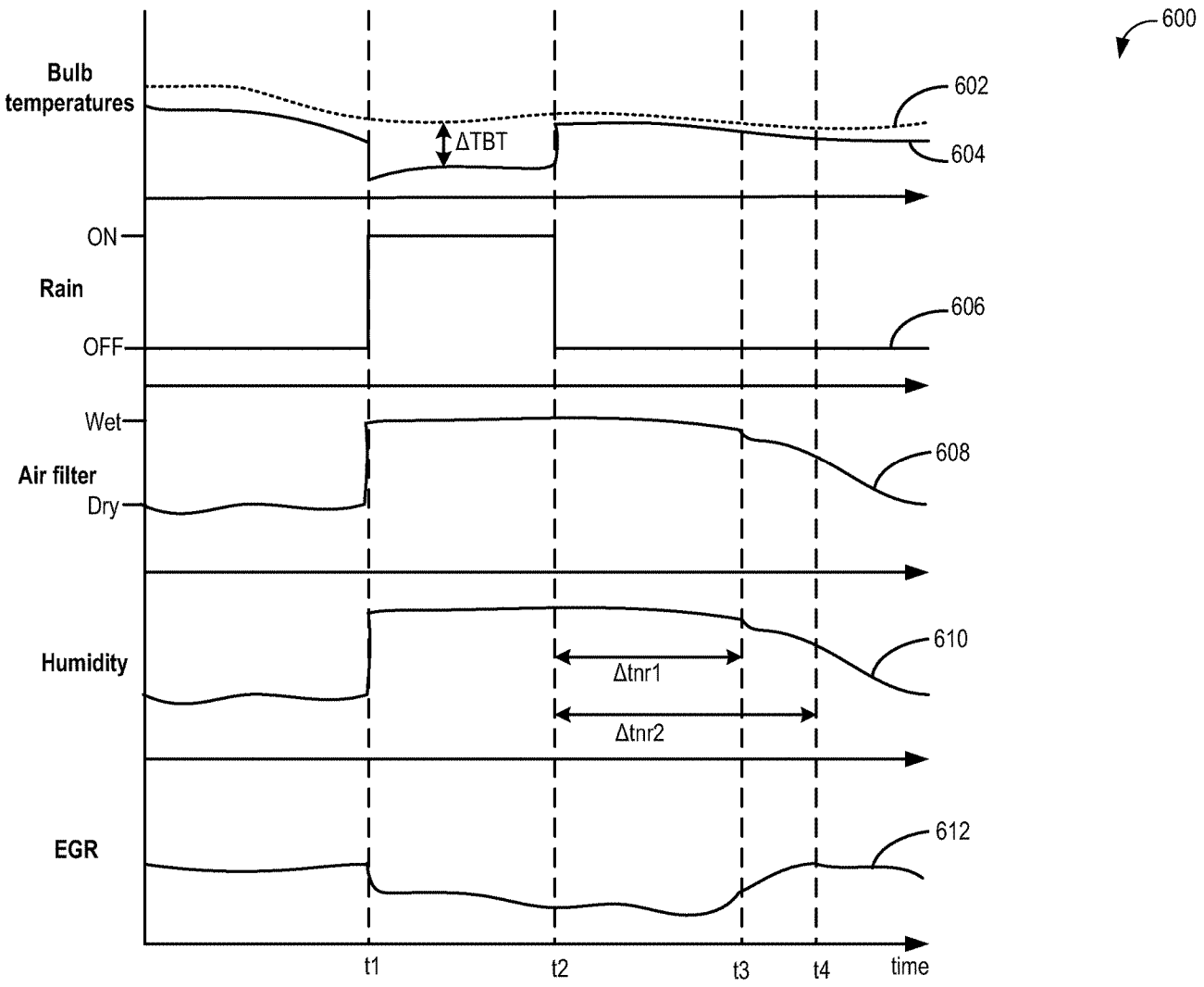
FIG. 6 shows example changes in humidity and dry and wet bulb temperatures in response to rain.

Turning now to FIG. 5, a method 500 for determining a precipitation condition based on a dry bulb temperature and a wet bulb temperature is shown. Precipitation may one or more of rain, fog, snow, freezing rain, hail, mist, etc.

At 504, the controller may measure wet bulb and dry bulb temperatures. As discussed above, wet bulb temperature may be a temperature of precipitation measured by a wet bulb thermometer located on an exterior surface of the vehicle and exposed to ambient weather conditions. In one example, wet bulb thermometer may be located at a base of a windshield of a vehicle (such as windshield 101 of vehicle 102 at FIG. 1). In another example, the wet bulb thermometer may be located on one or more side view mirrors of the vehicle (such as side view mirrors 103 at FIG. 1). In still another example, the wet bulb thermometer may be positioned on a grille of a grille system of the vehicle (such as grille system 115 at FIG. 1).

Dry bulb temperature may be a temperature of intake air, which may be measured by a dry bulb thermometer located in the intake manifold. In some examples, dry bulb temperature may be a temperature of the ambient air measured by a dry bulb thermometer located on an exterior of the vehicle and shielded from ambient weather.

Next, at 506, the controller may determine if a difference between the dry bulb temperature and the wet bulb temperature is greater than a threshold temperature difference. If the difference is greater than the threshold temperature difference, the controller may infer that precipitation is detected. Precipitation may one or more of rain, fog, snow, freezing rain, hail, mist, etc. In one example, rain may be determined based on the difference between the dry bulb temperature and the wet bulb temperature is greater than a first threshold temperature difference; and fog may be determined based on the difference between the dry bulb temperature and the wet bulb temperature is greater than a second threshold temperature difference. Subsequently, the controller may utilize the measured dry bulb and wet bulb temperatures to estimate ambient humidity. For example, upon determining that precipitation is present in the atmosphere surrounding the vehicle, the controller may execute steps 304 to 320 of routine 300 as discussed at FIG. 3 to estimate ambient humidity, and determine conditions for fog and/or black ice formation in an environment surrounding the vehicle. Further, engine operating parameters may be adjusted as discussed at FIG. 3 based on the estimated humidity.

If at 506, the difference between the dry bulb and wet bulb temperatures is not greater than the threshold temperature difference, it may be determined that precipitation is absent in the atmosphere surrounding the vehicle. Upon determining the absence of precipitation, the controller may utilize only the measured dry bulb temperature and not the measured wet bulb temperature to estimate ambient humidity. In some embodiments, in the absence of precipitation, humidity may be estimated based on the dry bulb temperature, barometric pressure, and weather information from navigation systems such as GPS. In another example, humidity may be estimated based on dry bulb temperature, barometric pressure, and concentration of one or more engine-out emissions. In still another example, humidity may be estimated based on one or more sensor information sent to the controller from various humidity sensors, such as an absolute humidity sensor, a relative humidity sensor, and others.

In some other embodiments, in the absence of precipitation, a wetness factor of an air filter disposed in an intake passage of an engine may be considered in the determination of humidity, and accordingly, the controller may execute routine 400 as discussed at FIG. 4 and estimate humidity based on dry bulb and wet bulb temperatures.

In further embodiments, upon detecting the presence of precipitation, information regarding the precipitation may be transmitted from the controller to an off-board network. Subsequently, the off-board network may transmit the information to one or more vehicles connected to the network. For example, the vehicle may be travelling in a geographic location where precipitation is present. The vehicle controller may detect the presence of precipitation and transmit the information (such as presence of precipitation, location where precipitation is detected, time when precipitation is detected, duration of precipitation, etc.) to the off-board network. The off-board network may receive information from one or more vehicles connected to the network and travelling in the same geographic location. Upon receiving the information, the off-board network may store the information, process the information and transmit the information to the one or more vehicles connected to the network that may potentially travel to the geographic location where precipitation is detected. Additionally and/or alternatively, the off-board network may transmit precipitation information for the geographic location upon request by one or more vehicles connected to the network.

In this way, by utilizing wet bulb and dry bulb temperatures to determine the presence of precipitation in an environment surrounding the vehicle, precipitation may be detected with improved speed.

In one example, a method for an engine may comprise: indicating a change in a rain condition based on a wet bulb temperature and a dry bulb temperature; and adjusting an estimated humidity based on the change in the rain condition, and not utilizing the wet bulb temperature to estimate humidity depending on the rain condition. For example, a change in rain condition may be a change from presence of rain in an environment surrounding a vehicle to absence of rain in an environment surrounding the vehicle. If rain is absent, wet bulb temperature may not be utilized in estimating humidity. In some examples, a wetness factor of intake filter contributing to the humidity may be considered in the absence of rain. Consequently, a previous wet bulb temperature may be considered in estimating humidity in the absence of rain and when the air filter may be wet (the contribution of air filter to humidity may be determined based on a duration of no rain, for example). Further, a dew point temperature of an atmosphere surrounding a vehicle may be determined, and fog and black ice formation may be inferred based on the dew point temperature and the dry bulb temperature.

Turning now to FIG. 6, it shows an example determination of humidity in response to rain. The humidity may be specific humidity and/or relative ambient humidity, for example. Specifically, graph 600 shows changes in dry bulb temperature at plot 602, changes in wet bulb temperature at plot 604, changes in a rain condition at plot 606, changes in intake air filter wetness at plot 608, changes in intake air humidity at plot 610, and changes in EGR flow based on intake air humidity at plot 612. All graphs are plotted against time on the x-axis. In alternate embodiments, one or more engine operating parameters in addition to or instead of EGR flow may be adjusted based on the intake air humidity. The one or more engine operating parameters may include spark timing, air-fuel ratio, and variable cam timing, among others. Additionally or alternatively, vehicle climate control parameters, such as cabin temperature, cabin humidity, cabin air flow, etc. may be adjusted based on the estimated intake air humidity.

As discussed above, dry bulb and wet bulb temperatures may be measured from dry bulb and wet bulb thermometers respectively. The rain condition, that is, presence or absence of rain in the air surrounding the vehicle may be determined based on dry bulb and wet bulb temperatures. Intake air humidity may be estimated based on dry bulb and/or wet bulb temperatures. EGR flow may be determined based on an area of opening of an EGR valve, a temperature of the EGR flow, a differential pressure across the valve, and a pressure downstream of the EGR valve.

Prior to time t1, rain may be absent in the air surrounding the vehicle. Accordingly, the difference between a dry bulb and a wet bulb temperature (ΔTBT) may be less than a threshold temperature. Further, the intake air filter may be dry. Therefore, prior to t1, humidity may be estimated based on the dry bulb temperature and not based on the wet bulb temperature. At t1, rain may be present in the air surrounding the vehicle. For example, the vehicle may travel from a dry location where there is no rain to a wet location where rain is present. Due to rain, there may be an increase in the difference between dry bulb and wet bulb temperatures (ΔTBT), and the difference (ΔTBT) may be greater than threshold. As a result, the controller may determine that rain is present surrounding of the vehicle and estimate humidity based on the wet bulb temperature and the dry bulb temperature. Further, due to the presence of rain, intake air humidity may increase (plot 610). Consequently, one or more engine operating parameters may be adjusted to maintain desired combustion conditions and/or prevent combustion instability. The one or more engine operating parameters may include EGR flow, spark timing, air-fuel ratio, and variable cam timing, among others. In this example, an example adjustment of EGR flow (plot 612) based on humidity is shown. Specifically, with increasing humidity, EGR flow may be decreased (as shown at plot 612) to maintain engine efficiency. Further, due to rain, a wetness factor of the intake air filter may increase (plot 608). In other words, during rainy conditions, rain water may enter the intake air filter causing the air filter to become wet.

Next, at t2, between t2 and t3, and at t3, rain may be absent in the air surrounding the vehicle. For example, the vehicle may travel from the wet location to a dry location. Consequently, the difference between the dry bulb temperature and the wet bulb temperature may be less than the threshold temperature. Based on the difference between the wet bulb and the dry bulb temperature being less than the threshold, the controller may determine that rain is absent in the surrounding of the vehicle. However, it may take a duration of time for the air filter to dry. As a result, the wetness of the intake air filter may contribute to the humidity of the intake air even when rain is absent. That is, at t2, at any time point between t2 and t3, and at t3, a duration of time elapsed (Δtnr1) between a time point a change in rain condition from rain to no rain had occurred and a current time point may be less than a threshold duration. Consequently, the wetness of the air filter may contribute to the humidity of intake air. Therefore, at t2, between t2 and t3, and at t3, the humidity may be estimated based on dry bulb and wet bulb temperatures, where the wet bulb temperature may be a latest temperature reading of the wet bulb thermometer measured during rainy conditions. In other words, the wet bulb temperature may be a latest wet bulb temperature measurement when ΔTBT is greater than threshold. In some examples, the humidity may be a function of the duration of time elapsed (Δtnr). That is, with increasing duration of time elapsed (from Δtnr1 to Δtnr2), the wetness of the air filter may decrease (plot 608), and consequently, humidity may decrease (plot 610). Further, as discussed above, one or more engine operating parameters may be adjusted based on the estimated humidity. For example, EGR flow may be adjusted based on humidity. Specifically, with increase in humidity above a threshold humidity, EGR flow may be decreased.

Next, between t3 and t4, at t4, and beyond t4, rain may continue to be absent (plot 606). However, the duration of time elapsed (Δtnr2) between the time point a change in rain condition from rain to no rain had occurred and a current time point may be greater than or equal to a threshold duration. Consequently, the wetness of the intake air filter may not contribute to the intake air humidity. As a result, between t3 and t4, at t4, and beyond t4, humidity may be estimated based on dry bulb temperature and not wet bulb temperature. Further, as discussed above, engine operating parameters may be adjusted based on the estimated humidity. For example, EGR flow may be adjusted (increased) based on humidity (decreased).

In one example, a method for an engine comprises: during a first condition when a difference between a wet bulb temperature of a wet bulb thermometer and a dry bulb temperature of a dry bulb thermometer is greater than a threshold temperature, a first humidity may be estimated based on a dry bulb temperature and the wet bulb temperature, and adjusting operation of the engine based on the first humidity; and during a second condition when the difference between the wet bulb temperature and the dry bulb temperature is less than the threshold temperature, a second humidity may be estimated based on the dry bulb temperature and not based on the wet bulb temperature, and adjusting operation of the engine based on the second humidity. The wet bulb temperature is a temperature of rain measured by a wet bulb temperature sensor located at one of a vehicle grille shutter, a side view mirror, or a base of a windshield and the dry bulb temperature is measured by a dry bulb temperature sensor located in an intake passage of the engine. Adjusting operation of the engine may include one or more of adjusting a mass air flow, spark timing, variable valve timing, or exhaust gas air-fuel ratio. Further, rain may be based on the second condition. Further, a dew point temperature may be determined based on the wet bulb temperature and the dry bulb temperature, and fog in an environment surrounding a vehicle may be determined based a difference between the dew point temperature and the dry bulb temperature less than a threshold fog temperature. Still further black ice may be determined in an environment surrounding the vehicle based on a difference between dew point temperature and the dry bulb temperature less than a threshold black ice temperature, and further based on the dry bulb temperature less than a black ice temperature. Still further, information based on rain, fog, and black ice may be transmitted from a controller of the engine to an off-board network via a wireless network to one or more vehicles connected to the off-board network.

In this way, by utilizing the wet bulb temperature to estimate ambient humidity during rain and during conditions when air filter is wet (for a duration after rain has stopped and until the air filter is dry, for example), change in humidity may be detected more quickly (e.g., relatively instantaneously), and humidity may be estimated with greater accuracy. Accordingly, engine operation adjusted based on the humidity estimated utilizing the wet bulb temperature as discussed herein may result in improved engine performance and emissions.

Note that the example control and estimation routines included herein can be used with various engine and/or vehicle system configurations. The control methods and routines disclosed herein may be stored as executable instructions in non-transitory memory. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for an engine of a road vehicle having wheels, comprising:

during a first condition when a difference between a first temperature of a first sensor positioned at an exterior surface of the vehicle and exposed to weather and a second temperature of a second sensor shielded from weather is greater than a threshold temperature, estimating a first humidity based on the second temperature and the first temperature, and adjusting operation of the engine based on the first humidity; and during a second condition when the difference between the first temperature and the second temperature is less than the threshold temperature, estimating a second humidity based on the second temperature and not based on the first temperature, and adjusting operation of the engine based on the second humidity.

2. The method of claim 1, wherein the first temperature is a temperature of rain measured by a first temperature sensor located at one of a vehicle grille shutter, a side view mirror, or a base of a windshield, and wherein the second temperature is measured by a second temperature sensor located in an intake passage of the engine.

3. The method of claim 1, wherein adjusting operation of the engine includes one or more of adjusting a mass air flow, spark timing, variable valve timing, or exhaust gas air-fuel ratio.

4. The method of claim 1, further comprising inferring rain based on the first condition.

5. The method of claim 4, further comprising determining a dew point temperature based on the first temperature and the second temperature, and determining fog in an environment surrounding the vehicle based on a difference between the dew point temperature and the second temperature being less than a threshold fog temperature.

6. The method of claim 5, further comprising determining black ice in the environment surrounding the vehicle based on a difference between the dew point temperature and the second temperature being less than a threshold black ice temperature, and further based on the second temperature being less than a black ice temperature.

7. The method of claim 6, further comprising transmitting information based on the determined rain, fog, and black ice from a controller of the engine to an off-board network via a wireless network.

* * * * *